US010588380B2

(12) United States Patent
Dekovic

(10) Patent No.: US 10,588,380 B2
(45) Date of Patent: Mar. 17, 2020

(54) UPPER HAVING BONDED DIFFERENTIALLY-ORIENTED INNER AND OUTER REINFORCING STRIPS

(71) Applicant: NIKE, Inc., Beaverton, OR (US)

(72) Inventor: Denis Dekovic, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/469,923

(22) Filed: Mar. 27, 2017

(65) Prior Publication Data

US 2017/0196308 A1 Jul. 13, 2017

Related U.S. Application Data

(62) Division of application No. 13/709,675, filed on Dec. 10, 2012, now Pat. No. 9,635,905.

(51) Int. Cl.
*A43B 23/02* (2006.01)

(52) U.S. Cl.
CPC ..... *A43B 23/0265* (2013.01); *A43B 23/0215* (2013.01); *A43B 23/0235* (2013.01); *A43B 23/0245* (2013.01); *A43B 23/0255* (2013.01)

(58) Field of Classification Search
CPC ..... A43B 23/0265; A43B 23/0255; A43B 23/0215; A43B 23/0235; A43B 23/0245; A43B 1/04; A43B 23/0225; A43B 23/0275; A43B 7/06; A43B 23/026; B29D 35/146
USPC ..... 36/44, 88, 55; 12/146 C
See application file for complete search history.

(56) References Cited

U.S. PATENT DOCUMENTS 1,548,172 A * 8/1925 Redden ..... A43B 7/20 36/53
1,663,319 A * 3/1928 Snell ..... A43B 1/02 12/142 V
1,695,225 A * 12/1928 Bohr ..... A43B 23/0205 12/142 V
1,773,681 A * 8/1930 Johnson ..... A43B 1/02 36/3 A
3,862,877 A * 1/1975 Camden ..... D04H 5/04 428/111
3,982,335 A * 9/1976 Cunningham ..... B29C 67/202 264/41
4,222,183 A * 9/1980 Haddox ..... A43B 5/00 36/114

(Continued)

FOREIGN PATENT DOCUMENTS

JP 2005160697 A 6/2005

*Primary Examiner* — Clinton T Ostrup
*Assistant Examiner* — Jocelyn Bravo
(74) *Attorney, Agent, or Firm* — Banner & Witcoff, Ltd.

(57) ABSTRACT

An upper may include a reinforced panel. The panel may comprise a carrier, inner reinforcing strips and outer reinforcing strips. The inner and outer reinforcing strips may be respectively bonded to interior and exterior faces of the carrier. Each of the inner reinforcing strips may be approximately parallel to at least one adjacent inner reinforcing strip and separated from that at least one adjacent inner reinforcing strip by one or more unreinforced portions of the carrier interior face. Each of the outer reinforcing strips may be approximately parallel to at least one adjacent outer reinforcing strip and separated from that at least one adjacent outer reinforcing strip by one or more unreinforced portions of the carrier exterior face.

20 Claims, 14 Drawing Sheets

(56) References Cited

U.S. PATENT DOCUMENTS 4,231,170 A * 11/1980 Griswold ..... A43B 3/16 36/72 R
4,447,967 A * 5/1984 Zaino ..... A43B 23/0235 36/45
4,756,098 A * 7/1988 Boggia ..... A43B 5/00 36/114
4,785,558 A * 11/1988 Shiomura ..... A43B 1/04 36/114
4,858,339 A * 8/1989 Hayafuchi ..... A43B 1/04 36/114
4,915,993 A * 4/1990 Ten Wolde ..... A47K 10/28 428/109
5,152,082 A * 10/1992 Culpepper ..... A43B 7/14 36/114
5,896,683 A * 4/1999 Foxen ..... A43B 7/20 36/89
6,004,891 A * 12/1999 Tuppin ..... A41D 31/0061 139/408
6,029,376 A * 2/2000 Cass ..... A43C 1/04 36/50.1
6,108,943 A 8/2000 Hudson et al.
6,170,175 B1 * 1/2001 Funk ..... A43B 5/04 36/115
6,539,647 B2 * 4/2003 Diaz ..... A43B 7/32 36/50.1
6,715,218 B2 * 4/2004 Johnson ..... A41D 13/0531 36/45
6,874,252 B2 4/2005 Nakano
6,910,288 B2 * 6/2005 Dua ..... A43B 1/04 12/146 C
7,155,846 B2 * 1/2007 Alfaro ..... A43B 1/0027 36/136
7,587,841 B2 * 9/2009 Culpepper ..... A43B 7/20 36/45
7,703,220 B2 4/2010 Aveni
7,793,435 B1 * 9/2010 Ruth ..... A43C 11/00 36/50.1
8,051,585 B2 * 11/2011 Hope ..... A43B 23/024 36/11.5
8,065,818 B2 * 11/2011 Greene ..... A43B 9/00 12/142 E
8,321,984 B2 12/2012 Dojan et al.
8,789,734 B2 * 7/2014 Cross ..... A45C 3/001 2/248
8,887,410 B2 * 11/2014 Dojan ..... A43B 23/0265 36/3 A
8,893,405 B2 * 11/2014 Dojan ..... A43B 3/26 36/45
9,144,269 B2 * 9/2015 Meschter ..... A43B 3/26
9,198,479 B2 * 12/2015 Dojan ..... A43B 23/0275
9,573,331 B2 * 2/2017 McDowell ..... B29D 35/146
9,635,905 B2 * 5/2017 Dekovic ..... A43B 23/0235
2002/0071946 A1 * 6/2002 Norton ..... A43B 5/002 428/304.4
2002/0078599 A1 * 6/2002 Delgorgue ..... A43B 7/12 36/98
2004/0213959 A1 * 10/2004 Chiang ..... B32B 7/12 428/156
2006/0048413 A1 * 3/2006 Sokolowski ..... A43B 23/0235 36/45
2007/0199210 A1 * 8/2007 Vattes ..... A43B 13/12 36/45
2010/0018075 A1 * 1/2010 Meschter ..... A43B 23/227 36/45
2010/0199520 A1 * 8/2010 Dua ..... A43B 1/04 36/87
2010/0266833 A1 * 10/2010 Day ..... B29C 44/1285 428/304.4
2010/0288812 A1 * 11/2010 Cross ..... A45C 3/001 224/643
2011/0088285 A1 * 4/2011 Dojan ..... A43B 1/04 36/87
2011/0197475 A1 * 8/2011 Weidl ..... A43B 1/0009 36/107
2012/0023778 A1 * 2/2012 Dojan ..... A43B 23/0275 36/58.5
2012/0144698 A1 * 6/2012 McDowell ..... B29D 35/146 36/45
2012/0151795 A1 6/2012 Ivester et al.
2013/0025075 A1 * 1/2013 Meschter ..... A43B 3/26 12/146 B
2013/0055590 A1 * 3/2013 Mokos ..... A43B 1/04 36/45
2013/0152423 A1 * 6/2013 Wu ..... A43B 23/0235 36/45
2014/0259760 A1 * 9/2014 Dojan ..... A43B 23/026 36/45
2016/0015126 A1 * 1/2016 Farris ..... A43B 13/141 36/88
2016/0058099 A1 * 3/2016 Panian ..... A43B 23/0265 36/84

* cited by examiner

UPPER HAVING BONDED DIFFERENTIALLY-ORIENTED INNER AND OUTER REINFORCING STRIPS

RELATED APPLICATIONS

This application is a divisional of application Ser. No. 13/709,675 filed on Dec. 10, 2012, which is incorporated herein by reference in its entirety.

BACKGROUND

Correct fit is an important consideration with regard to footwear. For example, it is well known that a shoe should be the correct length and width for a wearer's foot. In many contexts, however, other aspects of the "feel" of a shoe can also be quite important. Although it may include factors such as wearer comfort, the "feel" of a shoe can also involve certain other characteristics. One such characteristic is the degree to which a shoe upper provides the wearer with a sensation of a close fit. In various sports, for example, an athlete may desire a shoe in which one or more portions of the upper provide a snug fitting feel why still being relatively lightweight. There remains a need for improved footwear having uppers that provide a close-fitting feel, as well as a need for improved methods of fabricating such uppers.

SUMMARY

This Summary is provided to introduce a selection of concepts in a simplified form that are further described below in the Detailed Description. This Summary is not intended to identify key features or essential features of the invention.

In at least some embodiments, an upper may include a reinforced panel. The panel may comprise a carrier, inner reinforcing strips and outer reinforcing strips. The inner and outer reinforcing strips may be respectively bonded to interior and exterior faces of the carrier. In some such embodiments, each of the inner reinforcing strips may be approximately parallel to at least one adjacent inner reinforcing strip and separated from that at least one adjacent inner reinforcing strip by one or more unreinforced portions of the carrier interior face. Similarly, in certain embodiments each of the outer reinforcing strips may be approximately parallel to at least one adjacent outer reinforcing strip and separated from that at least one adjacent outer reinforcing strip by one or more unreinforced portions of the carrier exterior face.

Additional embodiments may include, without limitation, other uppers and upper components, shoes incorporating uppers or upper components, and methods for manufacturing uppers, upper components and/or shoes incorporating such uppers or upper components.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Definitions

Figure 1A:
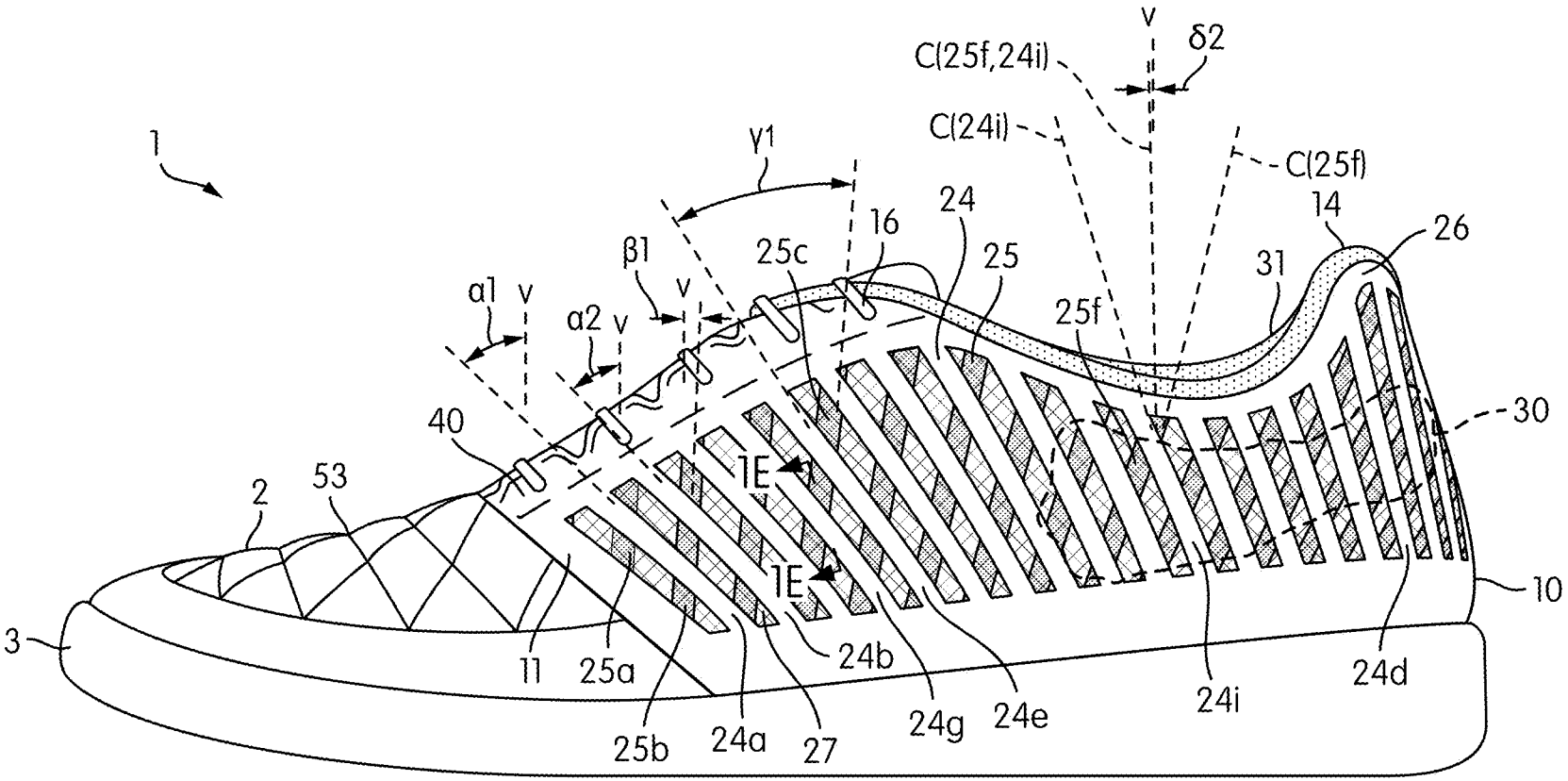
FIGS. 1A through 1D are lateral side, medial side, rear and front lateral perspective views of a shoe having an upper according to some embodiments.

To assist and clarify subsequent description of various embodiments, various terms are defined herein. Unless context indicates otherwise, the following definitions apply throughout this specification (including the claims). "Shoe" and "article of footwear" are used interchangeably to refer to an article intended for wear on a human foot. A shoe may or may not enclose the entire foot of a wearer. For example, a shoe could include a sandal or other article that exposes large portions of a wearing foot. The "interior" of a shoe refers to space that is occupied by a wearer's foot when the shoe is worn. An interior side, surface, face or other aspect of a shoe component refers to a side, surface, face or other aspect of that component that is (or will be) oriented toward the shoe interior in a completed shoe. An exterior side, surface, face or other aspect of a component refers to a side, surface, face or other aspect of that component that is (or will be) oriented away from the shoe interior in the completed shoe. In some cases, the interior side, surface, face or other aspect of a component may have other elements between that interior side, surface, face or other aspect and the interior in the completed shoe. Similarly, an exterior side, surface, face or other aspect of a component may have other elements between that exterior side, surface, face or other aspect and the space external to the completed shoe.

Unless the context indicates otherwise, "top," "bottom," "over," "under," "above," "below," and similar locational terms assume that a shoe or shoe structure of interest is in the orientation that would result if the shoe (or shoe incorporating the shoe structure of interest) is in an undeformed condition with its outsole (and/or other ground-contacting sole structure element(s)) resting on a flat horizontal surface. Notably, however, the term "upper" is reserved for use in describing the component of a shoe that at least partially covers a wearer foot and helps to secure the wearer foot to a shoe sole structure.

A "longitudinal" foot axis refers to a horizontal heel-toe axis along the center of the foot, while that foot is resting on a horizontal surface, that is generally parallel to a line along the second metatarsal and second phalangeal bones. A "transverse" foot axis refers to a horizontal axis across the foot that is generally perpendicular to the longitudinal axis. A longitudinal direction is parallel to the longitudinal axis or has a primary directional component that is parallel to the longitudinal axis. A transverse direction is parallel to a transverse axis or has a primary directional component that is parallel to a transverse axis. "Medial" and "lateral" have the meanings conventionally used in connection with footwear and/or foot anatomy.

Elements of a shoe can be described based on regions and/or anatomical structures of a human foot wearing that shoe, and by assuming that shoe is properly sized for the wearing foot. As an example, a forefoot region of a foot includes the metatarsal and phalangeal bones. A forefoot element of a shoe is an element having one or more portions located over, under, to the lateral and/or medial side of, and/or in front of a wearer's forefoot (or portion thereof) when the shoe is worn. As another example, a midfoot region of a foot includes the cuboid, navicular, medial cuneiform, intermediate cuneiform and lateral cuneiform bones and the heads of the metatarsal bones. A midfoot element of a shoe is an element having one or more portions located over, under and/or to the lateral and/or medial side of a wearer's midfoot (or portion thereof) when the shoe is worn. As a further example, a heel region of a foot includes the talus and calcaneus bones. A heel element of a shoe is an element having one or more portions located over, under, to the lateral and/or medial side of, and/or behind a wearer's heel (or portion thereof) when the shoe is worn. The forefoot region may overlap with the midfoot region, as may the midfoot and heel regions.

Exemplary Embodiments

In at least some embodiments, an upper may include a reinforced panel located at least within a heel region of a shoe. The reinforced panel may include a carrier layer formed from a mesh or other lightweight material. The reinforced panel may further include reinforcing strips configured so that the portion of the upper containing the reinforced panel may provide a wearer with a close-fitting feel. In some embodiments, those reinforcing strips may be differentially oriented. For example, and as described in further detail below, reinforcing strips located on one face of the carrier may have one orientation (or range of orientations) and reinforcing strips on an opposite face of the carrier may have a different orientation (or range of orientations).

Figure 1B:
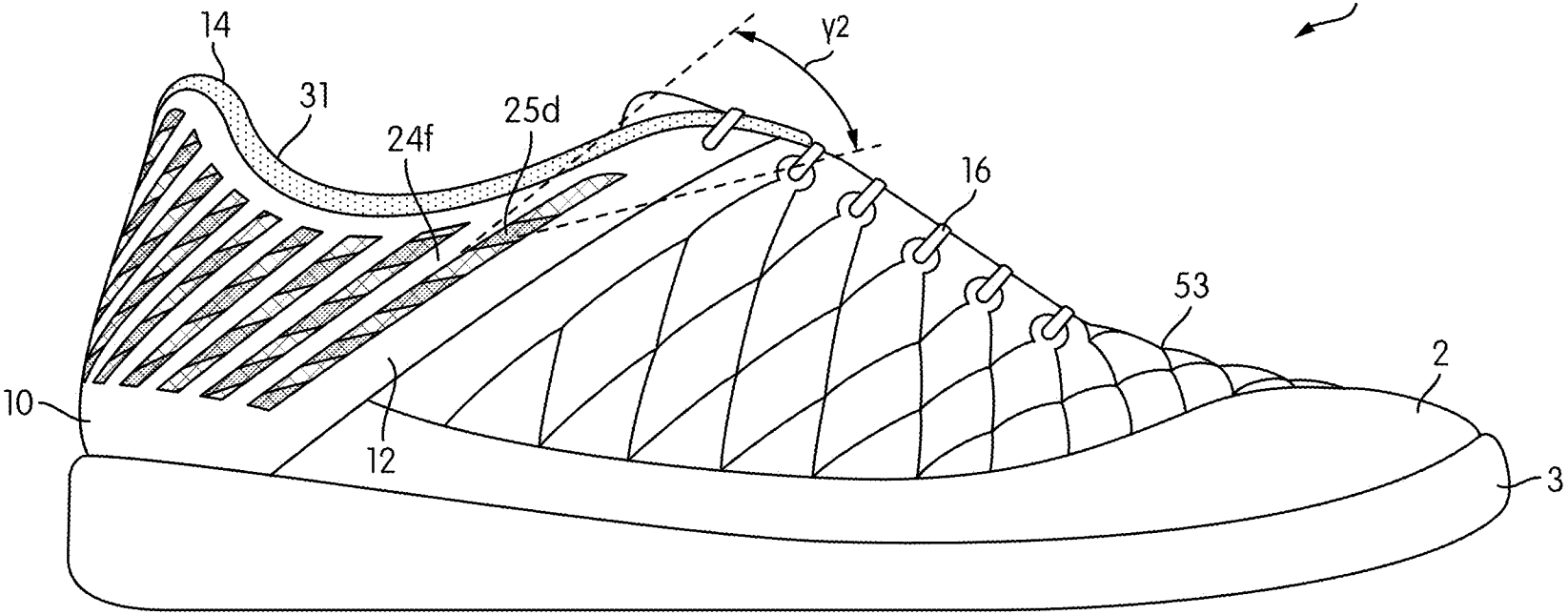
Figure 1C:
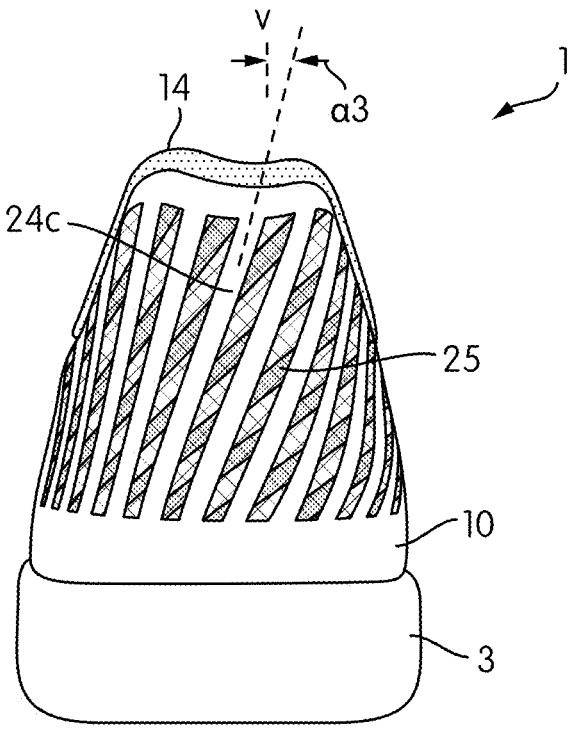
Figure 1D:
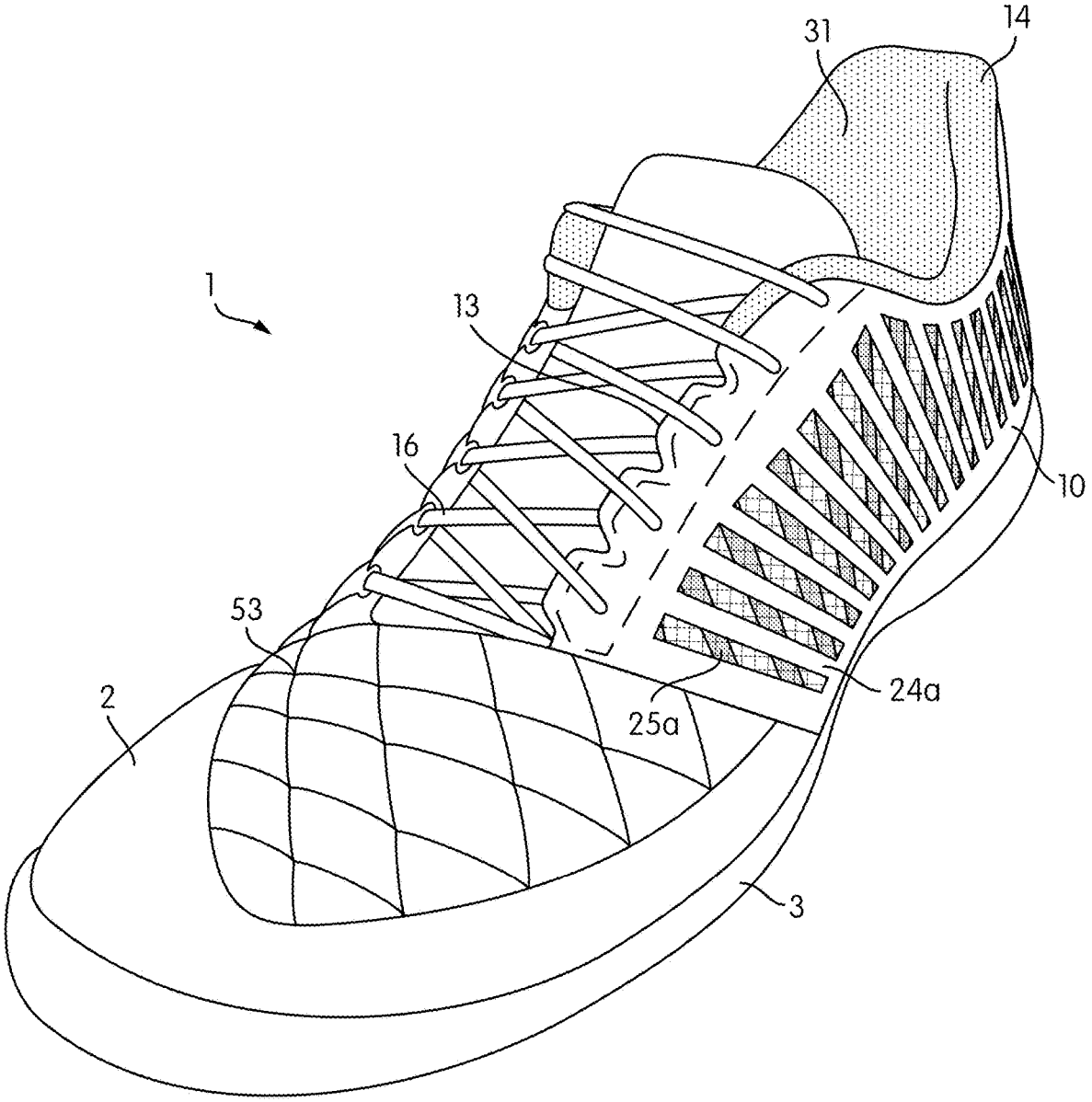

FIG. 1A is a lateral side view of a shoe 1 that includes an upper 2 according to some embodiments. Shoe 1 is a left foot shoe and is part of a pair that includes a right foot shoe (not shown) that is a mirror image of shoe 1. FIG. 1B is a medial side view of shoe 1. FIGS. 1C and 1D are a rear view and a front lateral perspective view, respectively, of shoe 1. Upper 2 is attached to a sole structure 3. Embodiments include shoes having sole structures of numerous widely varying types. A sole structure in some embodiments may be, e.g., a single piece molded from synthetic rubber or other material. In other embodiments, a sole structure may include multiple components that have been sequentially molded or otherwise bonded together. For example, a sole structure may include a midsole formed from a first material (e.g., foamed ethylene vinyl acetate) bonded to an outsole formed from different materials (e.g., synthetic rubber). A sole structure could also include one or more fluid-filled cushions, a stiffening plate or other support element(s), traction elements (e.g., cleats), etc. For convenience, and because of differing internal details of sole structures according to various embodiments, sole structure 3 is treated as a single unitary component in the drawing figures.

Upper 2 includes a reinforced panel 10. In the embodiment of shoe 1, and as seen in FIG. 1A, a front lateral edge 11 of reinforced panel 10 extends upward and forward across a forefoot metatarsal region. As seen in FIG. 1B, a front medial edge 12 of reinforced panel 10 extends upward and forward across heel and midfoot regions. For example, a bottom portion of edge 12 near sole structure 3 may be located in a region that corresponds to a wearer calcaneus, with edge 12 extending across regions that correspond to a wearer calcaneus, talus, navicular and cuneiforms. As seen in FIG. 1D, a portion of a top edge of reinforced panel 10 forms a lateral side of a tongue opening 13. Another portion of the reinforced panel 10 top edge is joined to a liner 31 that includes portions surrounding an ankle opening 14. A bottom edge of reinforced panel 10 is joined to a lasting element (e.g., a Strobel), not shown. In the embodiment of shoe 1, reinforced panel 10 thus extends over substantially all of upper 2 between edges 11 and 12.

Figure 1E:
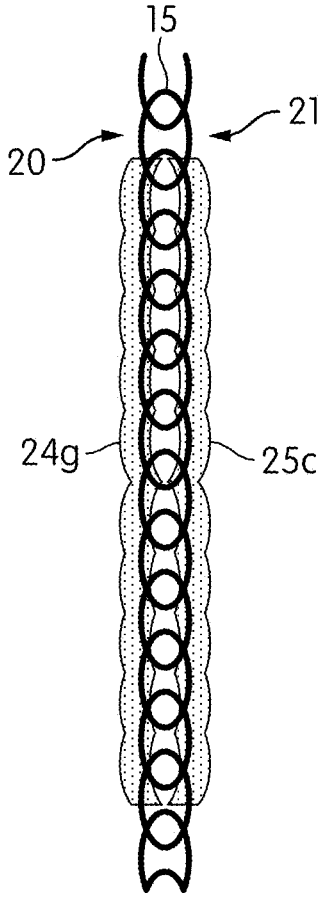
FIG. 1E is a partially schematic area cross-sectional view from the location indicated in FIG. 1A.

FIG. 1E is a partially schematic area cross-sectional view from the location indicated in FIG. 1A. Reinforced panel 10 includes a carrier 15. In at least some embodiments, carrier 15 may be cut from a single continuous piece of material that is lightweight, thin and strong. In at least some such embodiments, carrier 15 is formed from a polyester mesh material. The mesh material, which may be woven or nonwoven, includes substantial open spaces between fibers (or other structure elements of the mesh) through which air can flow.

Carrier 15 includes an exterior face 20 and an interior face 21. A set of reinforcing outer strips 24 are bonded to exterior face 20. A set of reinforcing inner strips 25 are bonded to interior face 21. In FIG. 1E, the cross-sectional plane passes through outer strip 24*g* and inner strip 25*c*. In some embodiments, and as described in more detail below, outer strips 24 and inner strips 25 are bonded to carrier 15 using a heated press. As a result of this heated pressing, and as shown schematically in FIG. 1E, a portion of the material of outer strips 24 and inner strips 25 fuses into carrier 15.

Outer strips 24 are readily visible in FIGS. 1A-1D. So as to avoid obscuring the drawing figures, only some of outer strips 24 are labeled. Although some of those outer strips are only labeled with reference number 24, reference numbers for certain outer strips further include an appended letter for purposes of more specific identification. As explained in more detail below, outer strips 24 are portions of a sheet 26 bonded to exterior face 20 of carrier 15. Each of outer strips 24 is separated from at least one adjacent outer strip 24 by an unreinforced portion of exterior face 20 of carrier 15. For example, and as indicated in FIG. 1A, outer strips 24*a* and 24*b* are separated by a portion 27 of exterior face 20 to which no outer strip is bonded. In some embodiments, reinforced panel 10 includes at least ten outer strips 24. In other embodiments, reinforced panel 10 includes at least twenty outer strips 24. In still other embodiments, reinforced panel 10 includes more than twenty five outer strips 24. Some or all of outer strips 24 may be elongated. In particular, some or all of outer strips 24 may have a length along a dimension extending generally between top and bottom edges of reinforced panel 10 and an average width exceeded by that length.

Because carrier 15 is a mesh in the embodiment of shoe 1, portions of inner strips 25 are also visible in FIGS. 1A-1D. So as to increase clarity, drawing figures showing a particular face of reinforced panel 10 will show reinforcing strips on the opposite face of reinforced panel 10 with light shading. Because FIGS. 1A-1D expose the exterior face of reinforced panel 10, inner strips 25 are lightly shaded in these views. As with outer strips 24, only some of inner strips 25 are labeled. Some inner strips are only labeled with reference number 25; others are labeled with reference number 25 and an appended letter for purposes of more specific identification. As explained below, inner strips 25 are portions of a separate sheet bonded to interior face 21 of carrier 15. Each of inner strips 25 is separated from at least one adjacent inner strip 25 by an unreinforced portion of interior face 21 of carrier 15. In some embodiments, reinforced panel 10 includes at least ten inner strips 25. In other embodiments, reinforced panel 10 includes at least fifteen inner strips 25. In still other embodiments, reinforced panel 10 includes more than twenty inner strips 25. Some or all of inner strips 25 may also be elongated (e.g., may have a length along a dimension extending generally between top and bottom edges of reinforced panel 10 and an average width exceeded by the length).

As seen in FIGS. 1A-1C, outer strips 24 have a range of orientations. For purposes of this description and the claims, the following convention is used when describing orientation angles of inner and outer reinforcing strips of shoe 1 or of a shoe according to another embodiment for which a reinforcing strip orientation angle is being described. With shoe 1 resting on a flat horizontal surface in an undeformed condition, the orientation angle is measured relative to a vertical axis (v) perpendicular to the horizontal surface. Orientation angle, as described herein, refers to an angle of a strip within a viewing plane. It is further assumed that the shoe upper is "filled out," i.e., in an uncompressed condition it would have when the shoe is worn.

Outer strip 24*a* has an orientation that is angled from a vertical axis v, and toward the front of shoe 1, at an acute angle $\alpha$1. Outer strip 24*b* has an orientation that is angled from a vertical axis v, and toward the front of shoe 1, at an acute angle $\alpha$2. Angle $\alpha$2 may be slightly less than $\alpha$1. The angles $\alpha$ of additional outer strips 24 rearward of outer strip 24*b* progressively decrease. Moving from the rear portion of the lateral side and around the heel region, however, the orientations of outer strips 24 are angled from the other side of corresponding vertical axes (when viewed outside the shoe). For example, and as seen in FIG. 1C, outer strip 24*c* has an orientation angle $\alpha$3 to the right of a vertical axis v. As can be appreciated from FIG. 1B, however, such medial side orientation angles to the right of vertical axes are toward the front of shoe 1. In the embodiment of shoe 1, outer strip orientation angles $\alpha$ are to the left of a vertical axis and gradually decrease when moving from front lateral edge 11 toward the rear until reaching a vertical or nearly vertical outer strip (e.g., outer strip 24*d* in FIG. 1A). From that vertical or nearly vertical outer strip, and moving around the heel region and toward front medial edge 12, externally viewed outer strip reinforcing angles $\alpha$ are to the right of vertical axes and gradually increase.

In the embodiment of shoe 1, and for most or all outer strips 24, each of those strips is parallel to or approximately parallel to one or more adjacent outer strip(s) 24. Two exterior or inner strips may be considered "approximately" parallel if the angle between their centerlines is less than about 5°. For a strip that is not a parallelogram, (e.g., a strip having a trapezoidal shape), a centerline can be taken as a line of midpoints between the two long sides of the strip along a major portion of the strip length. For strips that have a slight curvature, the centerline can be taken between the ends of a line of midpoints between the two long sides of the strip along a major portion of the strip length.

In some embodiments, a portion of spaces between some of outer strips 24 in a lateral heel region may be filled so as to create an area 30. Such an area could be used for, e.g., a product logo. In certain such embodiments, area 30 may extend across a rear of upper 2, and may further extend into a rear medial region. In other such embodiments, area 30 may be primarily (or exclusively) in the rear medial region.

Inner strips 25 also have a range of orientations. However, the orientations of inner strips 25 differ from those of outer strips 24. For example, and as seen in FIG. 1A, inner strip 25*a* near front lateral edge 11 has an orientation that is vertical or nearly vertical. Inner strip 25*b* has an orientation that is angled from the vertical, and toward the rear of shoe 1, at an acute angle $\beta$1. As shown in FIG. 1A, angle $\beta$1 is angled to the right of a vertical axis v. In the embodiment of shoe 1, most or all inner strips 25 have orientation angles $\beta$ to the right of a corresponding vertical axis when considered from a point of view external to shoe 1. Those orientation angles $\beta$ gradually increase when moving rearward across the lateral side, around the rear (FIG. 1C) and toward front medial edge 12 (FIG. 1B). In the embodiment of shoe 1, and for all or most of inner strips 25, each strip is parallel to or approximately parallel to one or more adjacent inner strip(s) 25 and is separated from adjacent inner strip(s) by one or more portions of carrier 15 inner face 21 to which no inner strip is bonded.

The differentiated orientations of outer strips 24 relative to inner strips 25 create angled lines of reinforcement. For example, and as shown in FIG. 1A, the centerline of outer strip 24*e* forms an acute angle $\gamma$1 relative to the centerline of inner strip 25*c*. Similar acute angles are formed between the centerlines of other outer strips 24 and inner strips 25 on the lateral side of reinforced panel 10. As shown in FIG. 1B, the centerline of outer strip 24*f* forms an acute angle $\gamma$2 relative to the centerline of inner strip 25*d*. Similar acute angles are formed between the centerlines of other outer strips 24 and inner strips 25 on the medial side of reinforced panel 10, as well as in the rear of reinforced panel 10. When a wearer places his or her foot into the interior of upper 2 and secures shoe 1 in place by tightening laces 16, and as the wearer engages in activity, tension is imposed on many of strips 24 and 25 (particularly in the more forward portions of the lateral and medial sides of reinforced panel 10). This tension pulls generally along the centerlines of these strips 24 and 25. This pulling on crossed lines of tension helps to provide a more secure, close-fitting feeling to a shoe 1 wearer across a range of motions.

Figure 2A:
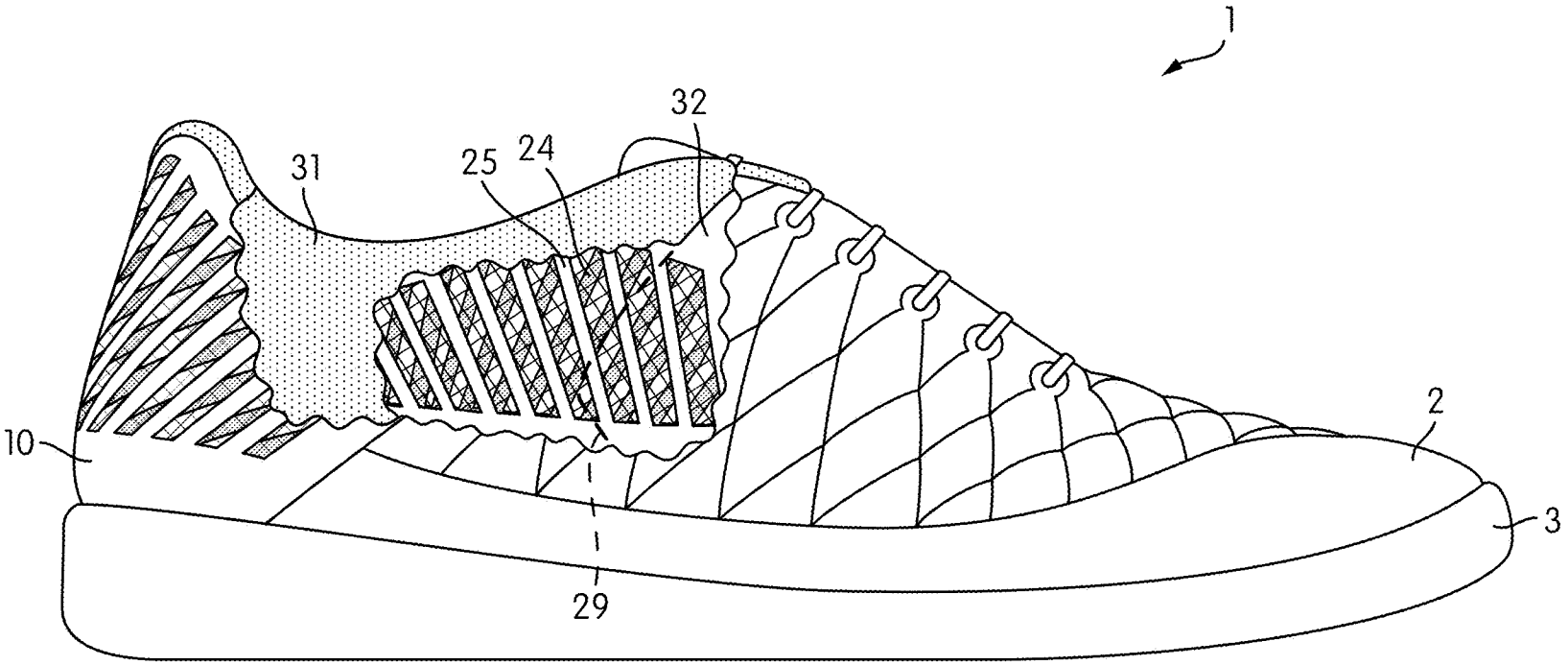
FIG. 2A is a partially cut away medial side view of the shoe of FIGS. 1A-1D.

FIG. 2A is a partially cut away medial side view of shoe 1 showing details of the interior lateral face of reinforced panel 10. Upper 2 includes a liner 31 that covers ankle collar 14 and interior portions of upper 2 in the heel region. So as to distinguish liner 31 from other elements, liner 31 is shown with a light stippling pattern in the drawings. A portion of liner 31 has also been removed in FIG. 2A so as to expose the interior lateral face of reinforced panel 10. The forward edge 29 of liner 31 is indicated by a broken line. In some embodiments, liner 31 is secured to reinforced panel 10 at the top and bottom edges, but is generally not attached to reinforced panel 10 between those top and bottom edges. Liner 31 may include a layer of foam padding for increased wearer comfort. A counter, not shown, may be included in liner 31 or situated between liner 31 and reinforced panel 10.

Figure 2B:
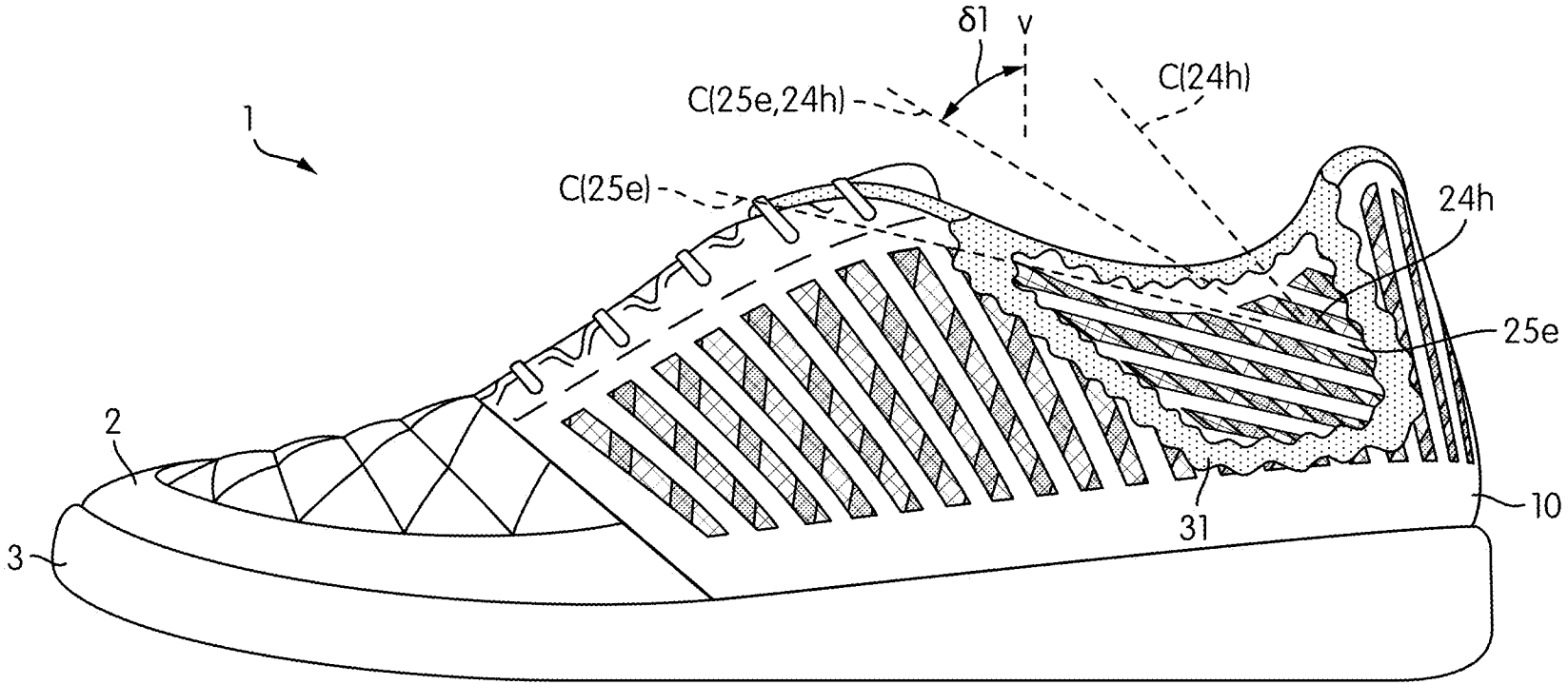
FIG. 2B is a partially cut away lateral side view of the shoe of FIGS. 1A-1D.

FIG. 2A more clearly shows inner reinforcing strips 25 in the forward lateral portion of reinforced panel 10. Because of the mesh nature of carrier 15, portions of outer strips 24 are also visible when viewing the interior face of reinforced panel 10. Similar to the external views of shoe 1 in FIGS. 1A-1D, a light shading is applied to reinforcing strips on the opposite face of reinforced panel 10 so as to increase drawing clarity. In the case of FIGS. 2A and 2B, outer strips 24 are thus shown as lightly shaded when seen from the inside of shoe 1. As can be appreciated from FIG. 2A, the orientation angles of inner strips 25 increase toward the rear of the lateral side. Inner strips 25 are part of a sheet 32 bonded to interior face 21 of carrier 15.

FIG. 2B is a partially cut away lateral side view of shoe 1 showing details of the interior medial face of reinforced panel 10 on the medial side. A portion of the interior medial side of liner 31 has also been removed. As seen in more detail in FIG. 2B, particularly in comparison to FIG. 1A, the overall reinforcement in the rear medial region of reinforced panel 10 has a more forward inclination than the overall reinforcement in the corresponding rear lateral region. For example, the geometric center of the tension lines associated with inner strip 25*e* and outer strip 24*h* is indicated in FIG. 2B with a broken line labeled C(25*e*, 24*h*). The angle between line C(25*e*, 24*h*) and the centerline of inner strip 25*e* (C(25*e*)) is the same as the angle between line C(25*e*, 24*h*) and the centerline of outer strip 24*h* (C(24*h*)). The angle of line C(25*e*, 24*h*) relative to a vertical axis is shown as δ1. In FIG. 1A, the geometric center of the tension lines associated with outer strip 24*i* (having a centerline C(24*i*)) and inner strip 25*f* (having a centerline C(25*f*)) is indicated with a broken line labeled C(24*i*, 25*f*). The angle of line C(24*i*, 25*f*) relative to a vertical axis is shown as δ2. Angle δ1 may be significantly greater than angle δ2. As can be generally appreciated from FIGS. 1A and 2B, the angles δ associated with other pairs of inner and outer strips in the rear medial region are also significantly greater than angles δ associated with other pairs of inner and outer strips in the rear lateral region.

In at least some embodiments, reinforced panel 10 may be fabricated using a process such as is described in commonly-owned U.S. patent application Ser. No. 12/603,498, filed Oct. 21, 2009, and titled "Composite Shoe Upper and Method of Making Same," which application is incorporated by reference herein in its entirety. In particular, sheet 26 (comprising outer strips 24), carrier 15, and sheet 32 (comprising inner strips 25) may assembled in a flat configuration. In that flat assembly, sheet 26, carrier 15 and sheet 32 are arranged so as to have the same relative alignment that will exist in the completed reinforced panel. Additional elements may also be included in that assembly. For example, eye stay reinforcement 40 (see FIG. 1A) can be placed between sheets 26 and 32 in the appropriate location. The assembly may then be subjected to a heated pressing between two silicone pads. During that pressing, faces of sheets 26 and 32 melt and flow into the interstices of carrier 15. After the heated pressing, the assembly may be subjected to a second pressing between unheated silicone pads. After the conclusion of the pressing operations, reinforced panel 10 may be subjected to trimming and other finishing operations (e.g., punching of eyelet holes) prior to incorporation with other elements of upper 2.

In some embodiments, the above-described assembly and pressing operations can be performed using a dual pan assembly jig. Such a jig, as well as associated techniques for using same, are also described in application Ser. No. 12/603,498.

Figure 3A:
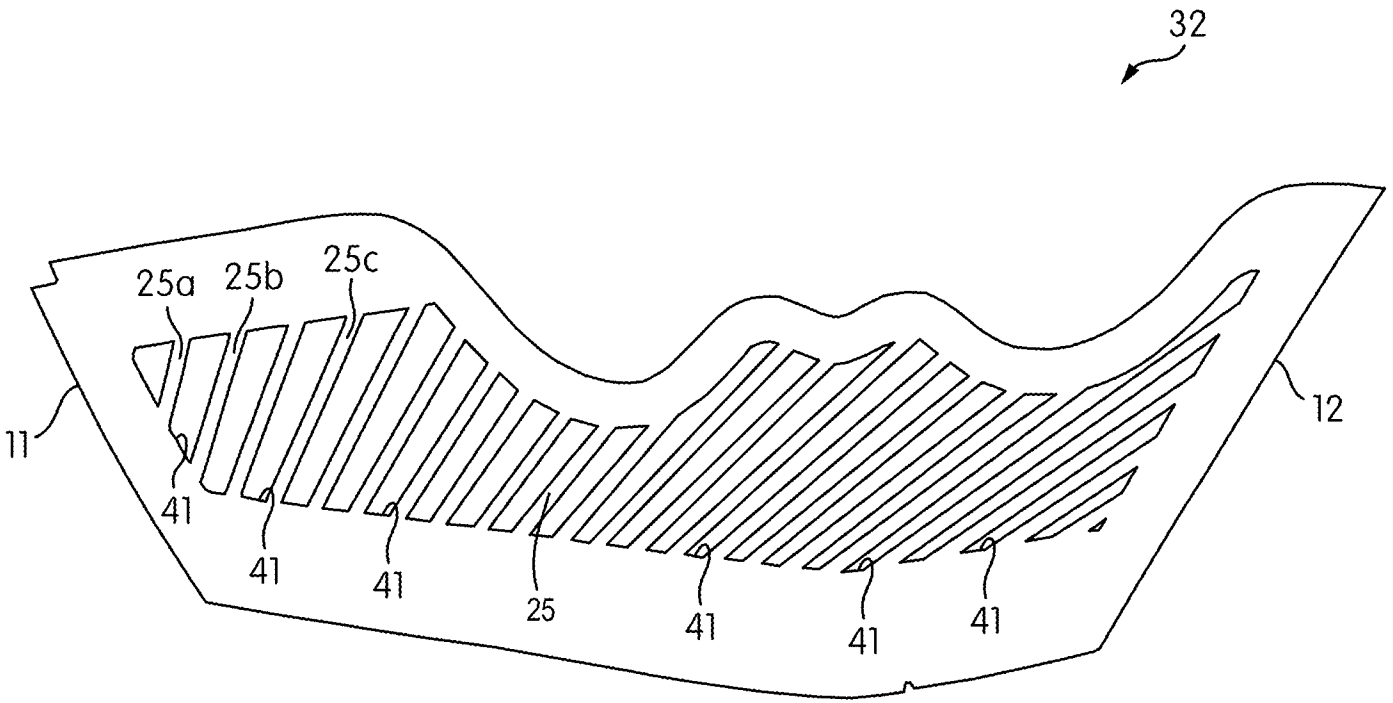
FIGS. 3A through 3C show individual components of a reinforced panel of an upper according to some embodiments.
Figure 3B:
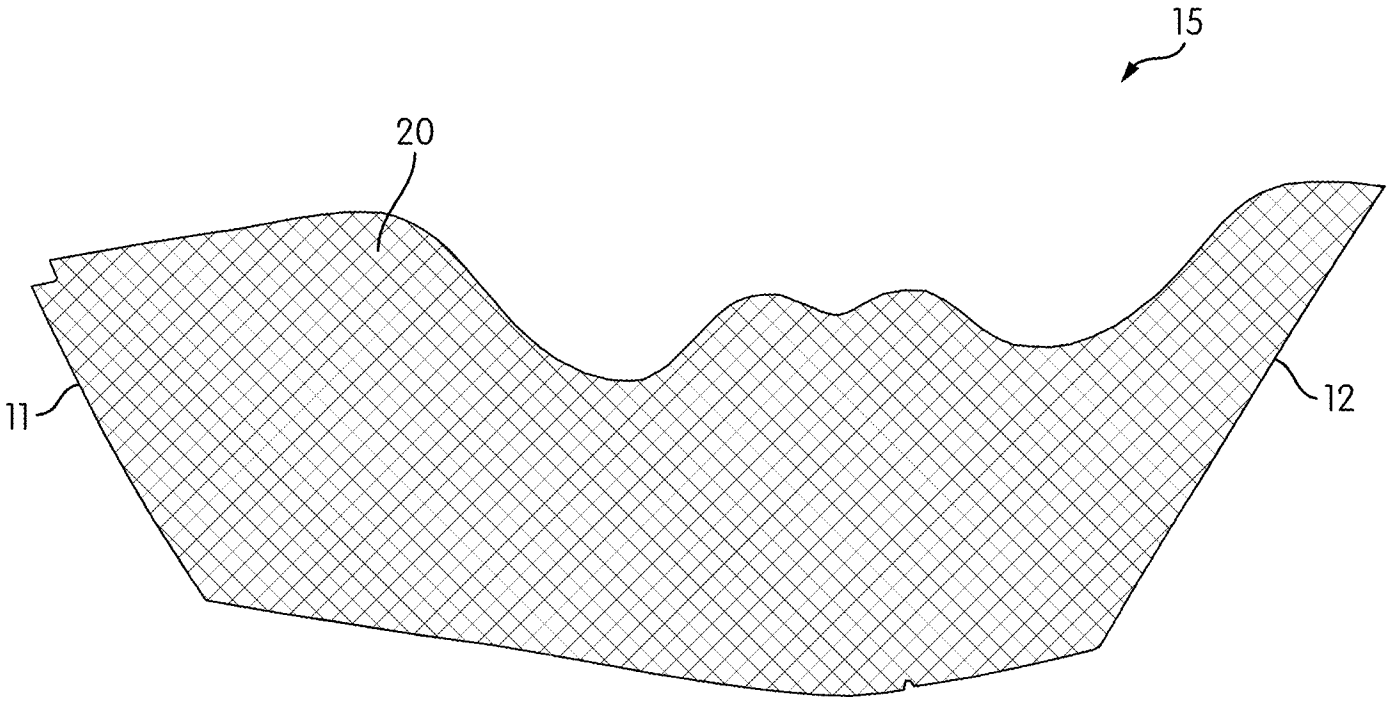
Figure 3C:
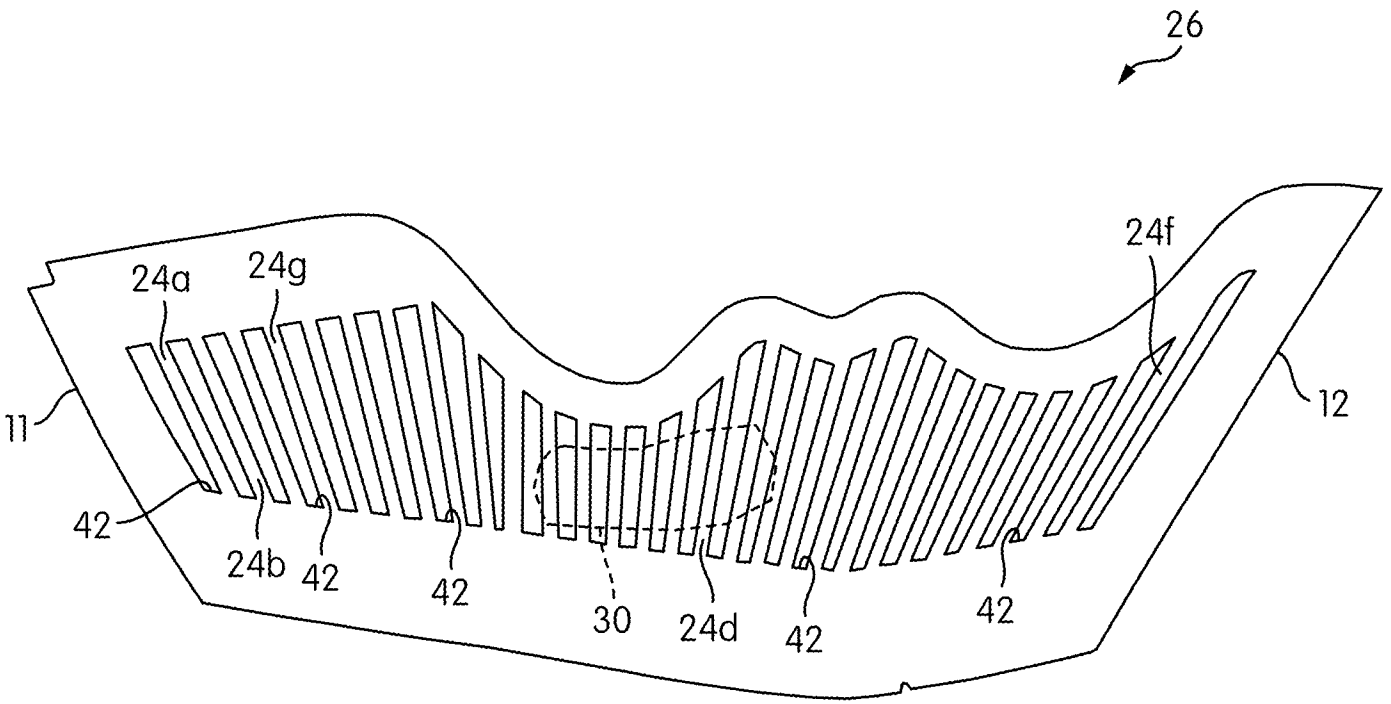

FIGS. 3A-3C show individual components of reinforced panel 10 in some embodiments. FIG. 3A shows sheet 32 prior to assembly with carrier 15 and sheet 26. In FIG. 3A, the exterior face of sheet 32 is shown. Exemplary materials for sheet 32 include 0.4 mm thick thermoplastic polyurethane (TPU) film having a polyurethane (PU) coating on one face. Sheet 32 can be die cut from a larger piece of that film. Inner reinforcing strips 25 can be formed by removing portions of the film material from spaces 41 that define strips 25. So as to avoid obscuring FIG. 3A, all spaces 41 are not marked. Sheet 32 may be cut and assembled with other elements of reinforced panel 10 so that the PU coated face of sheet 32 is part of the interior face of reinforced panel 10.

FIG. 3B shows carrier 15 prior to assembly with sheets 26 and 32. In FIG. 3B, exterior face 20 of carrier 15 is shown. Exemplary materials for carrier 15 include a polyester bull-head mesh (e.g., a single jersey textile mesh). Carrier 15 can be die cut from a larger piece of that mesh material. In at least some embodiments, carrier 15 is a single continuous piece of material. During assembly of reinforced panel 10, interior face 21 of carrier 15 may be laid over the exterior face of sheet 32.

FIG. 3C shows sheet 26 prior to assembly with carrier 15 and sheet 32. In FIG. 3C, the exterior face of sheet 26 is shown. Exemplary materials for sheet 32 also include the aforementioned 0.4 mm thick TPU film having a PU coating on one face. Sheet 26 can also be die cut from a larger piece of that film. Outer reinforcing strips 24 can be formed by removing portions of the film material from spaces 42 that define strips 24. All spaces 42 are not labeled. In embodiments where one or more outer strips may be linked as part of an area 30, a die used to cut sheet 26 can be modified so as to eliminate some or all portions of certain spaces 42. Sheet 26 may be cut and assembled with other elements of reinforced panel 10 so that the PU coated face of sheet 26 is part of the exterior face of reinforced panel 10. During assembly of reinforced panel 10, the interior face of sheet 26 may be laid over exterior face 20 of carrier 15.

Figure 4A:
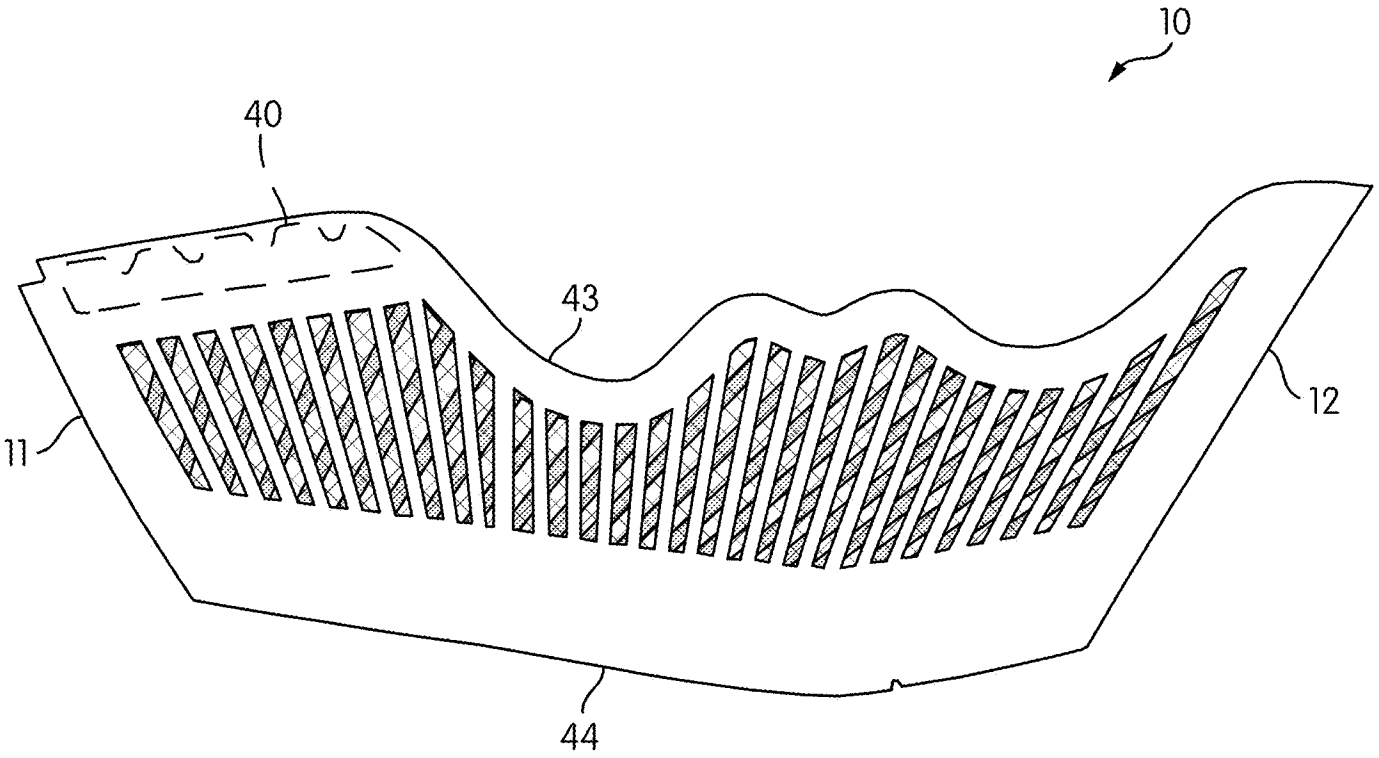
FIGS. 4A and 4B respectively show the exterior and interior faces a reinforced panel of an upper according to some embodiments.
Figure 4B:
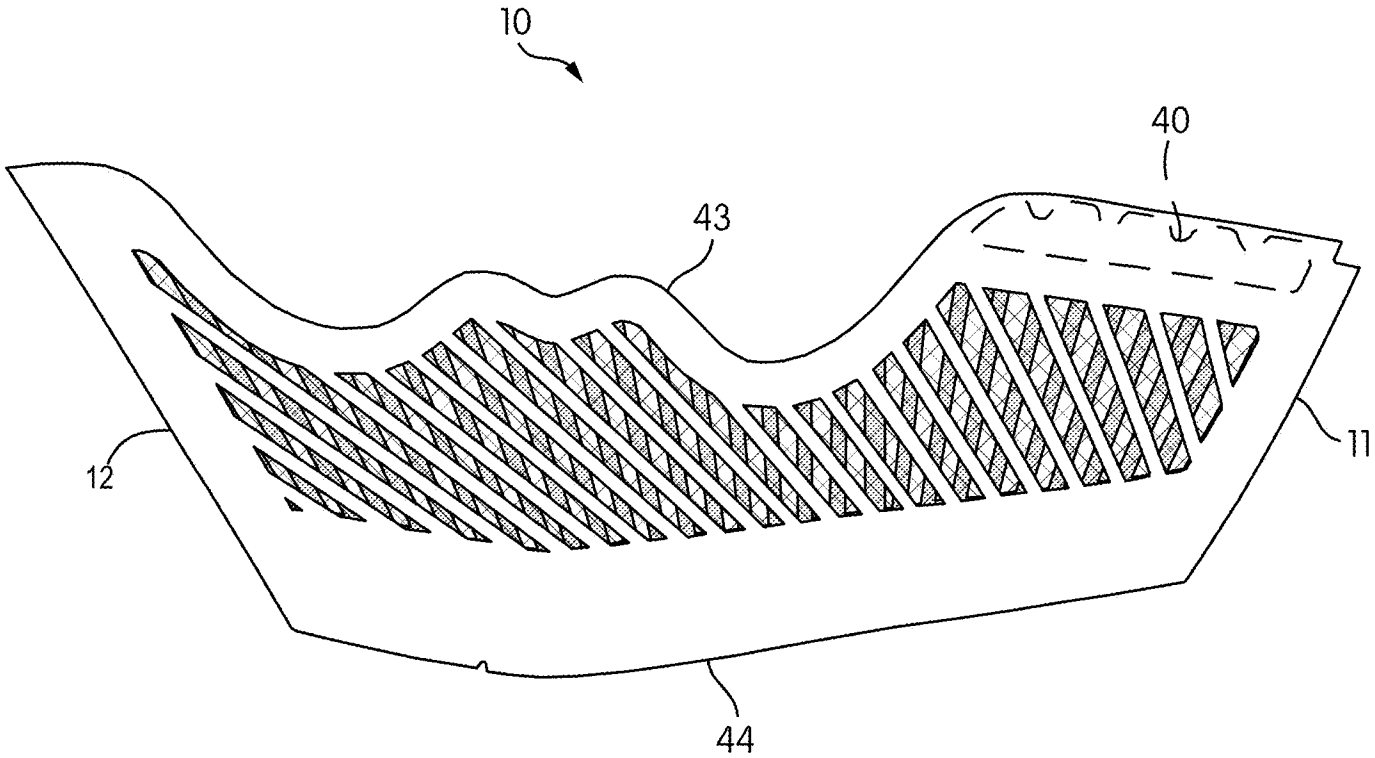

FIGS. 4A and 4B respectively show the exterior and interior faces of reinforced panel 10 after assembly, pressing and trimming, and prior to incorporation with other components of upper 2. An portion of a top edge 43 of reinforced panel 10 will subsequently be attached to the top edge of liner 31. After assembly of reinforced panel 10 with other elements, bottom edge 44 will be folded under and attached to a Strobel or other lasting element. Also seen in FIGS. 4A and 4B is eye stay reinforcement 40. As previously indicated, reinforcement 40 can be incorporated into reinforced panel 10 during the above-described assembly operations.

Figure 5A:
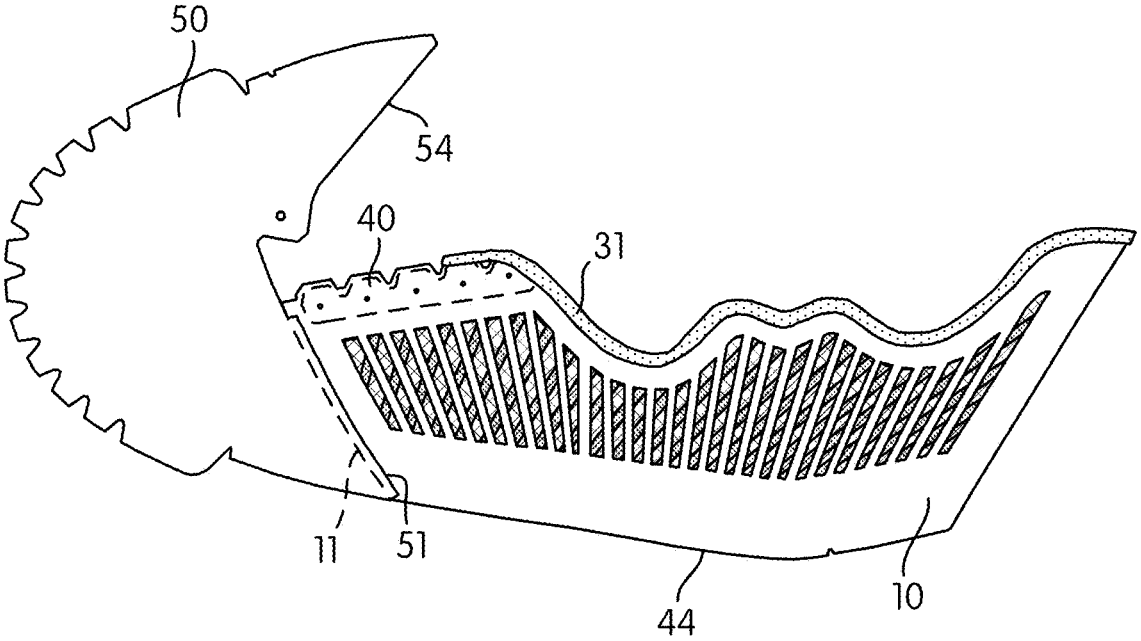
FIGS. 5A and 5B shows additional steps in the assembly of an upper that includes the reinforced panel of FIGS. 4A and 4B.
Figure 5B:
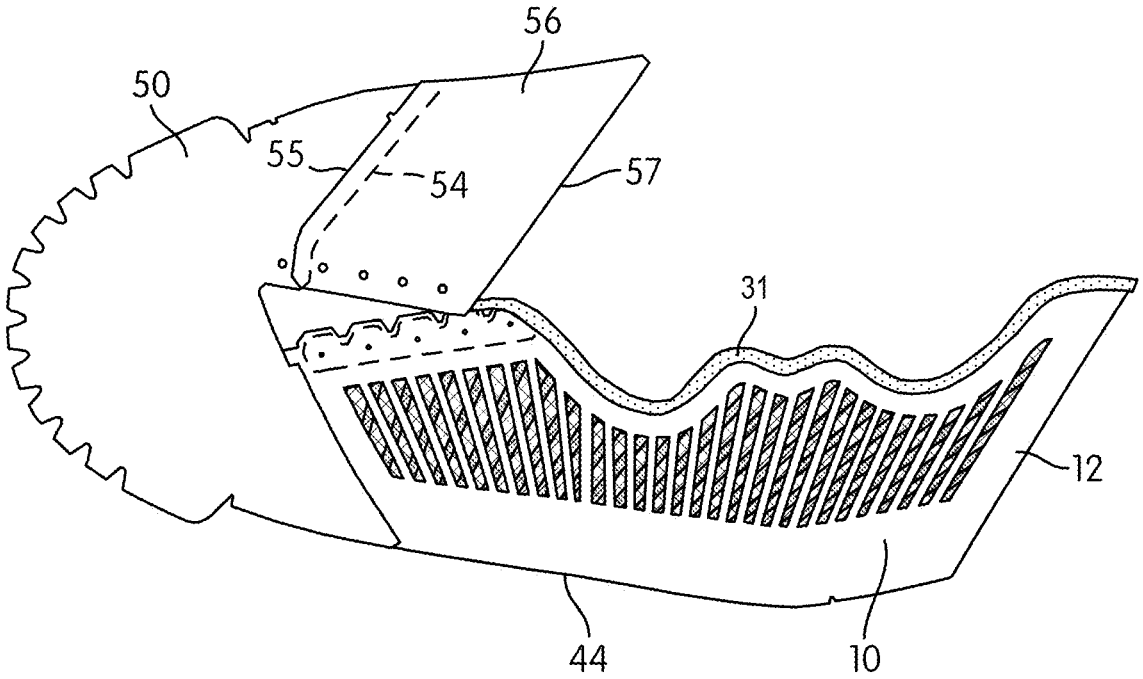

FIGS. 5A and 5B show additional steps in the assembly of upper 2. As shown in FIG. 5A, liner 31 has been attached to a portion of top edge 43 of reinforcement panel 10. Reinforcement panel 10 has also been trimmed (e.g., around eye stay reinforcement 40) and eyelets have been punched. Front lateral edge 11 of reinforced panel 10 is attached to a corresponding edge 51 of a forefoot element 50 using adhesive, stitching and/or another attachment mechanism. In the embodiment of shoe 1, forefoot element 50 may comprise multiple sub-elements. For example, forefoot element 50 may include an outer layer, an inner lining and a layer of foam padding interposed between the outer layer and lining. A stitching pattern 53 (see FIGS. 1A, 1B and 1D) may secure the sub-elements and create a quilted effect.

As shown in FIG. 5B, an edge 55 of a medial midfoot element 56 is attached to an edge 54 of forefoot element 50 using adhesive, stitching and/or another attachment mechanism. In the embodiment of shoe 1, midfoot element 56 may also comprise multiple sub-elements (e.g., an outer layer, a padding layer and a liner) that are stitched together in a pattern 53 to create a quilted effect.

In subsequent steps (not shown), upper 2 is completed. A tongue is attached on the interior face of forefoot element 50, and forward medial edge 12 of reinforced panel 10 is attached to edge 57 of midfoot element 56, using adhesive, stitching and/or another attachment mechanism. The bottom edge of the upper (including bottom edge 44 of reinforced panel 10) is then folded under and stitched and/or otherwise secured to a Strobel or other type of lasting element. Additional elements such as a toe box reinforcement may also be attached. After upper 2 is completed, it may then be attached to sole structure 2 using adhesive or other type of bonding. An insole may then be inserted into the interior or the upper.

Figure 6:
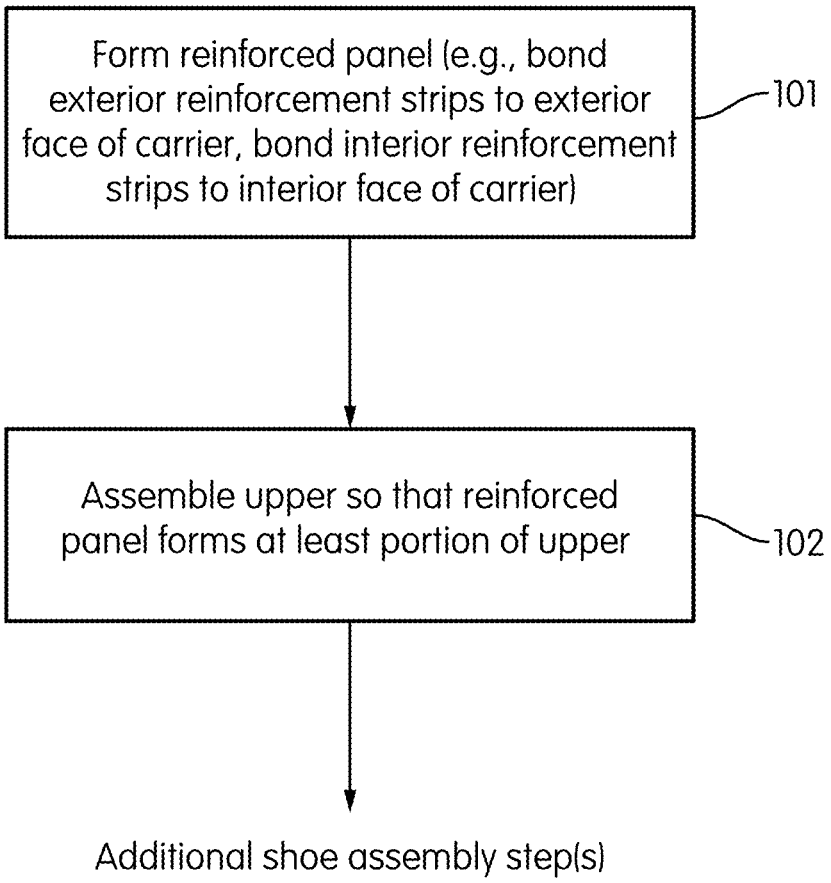
FIG. 6 is a flow chart showing steps of a method for fabricating an upper according to at least some embodiments.

FIG. 6 is a flow chart showing steps of a method for fabricating an upper according to at least some embodiments. In block 101, a reinforced panel such as reinforced panel 10 is formed. As part of forming the reinforced panel, outer reinforcement strips are bond to an exterior face of a carrier and inner reinforcement strips are bonded to an interior face of a carrier. In at least some embodiments, forming the reinforced panel comprises bonding sheets (such as sheets 26 and 32) to a carrier (such as carrier 15) in a manner as described above.

In block 102, the upper is assembled so that the reinforced panel from block 101 forms at least a portion of the upper. In some embodiments, the upper is assembled so that the reinforced panel forms a portion of the upper extending from at least the medial heel region, around the rear of the upper, and to at least the lateral heel region. As part of this assembly, and as described above, the reinforced panel may be attached to additional elements of the upper (e.g., liner 31, forefoot element 50, medial midfoot element 56, a tongue). Also as part of block 102, edges (e.g., edges 12 and 57) may be joined to convert the upper from a substantially flat piece into a three dimensional shape having a front, a rear and medial and lateral sides. Block 102 may further include attaching bottom edges of the upper to a Strobel or other lasting element. From block 102, one or more additional shoe assembly steps may be performed (e.g., bonding to a sole structure as described above).

Other embodiments may include features other than, or in addition to, features such as those described above. Reinforced panels in some embodiments may extend over different portions of an upper. As but one example, a reinforced panel could extend forward on the medial side in a manner similar to the lateral side of reinforced panel 10 of shoe 1 (e.g., to a medial metatarsal region). As but another example, a reinforced panel could extend upward to an ankle collar that is higher than ankle collar 14 (e.g., in a high top shoe). As yet another example, a reinforced panel may extend to or beyond a forefoot metatarsal region on the medial and/or lateral side. As a further example, a carrier of a reinforced panel may extend well into the forefoot region on the medial and/or lateral sides, but reinforcement strips may only be included in the midfoot and heel regions of that carrier.

Other embodiments may also include reinforcement strip patterns that differ from those shown in connection with reinforced panel 10. As indicated above, the number of outer and/or inner strips could vary. The orientation angles of strips could also be varied. Widths of reinforcing strips could also vary. For example, a set of outer (or inner) strips could include alternating thick and thin strips. Materials other than those described above could be used for a carrier and/or for reinforcing strips. Inner and outer reinforcing strips need not be formed from the same material.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from above-described embodiments are the within the scope of the invention. With regard to claims directed to an article of manufacture or some other physical component or combination of components, a reference in the claim to a potential or intended wearer or a user of a component does not require actual wearing or using of the component or the presence of the wearer or user as part of the claimed component or component combination. With regard to claims directed to methods for fabricating a component or combination of components, a reference in the claim to a potential or intended wearer or a user of a component does not require actual wearing or using of the component or the participation of the wearer or user as part of the claimed process.

The invention claimed is:

1. A method of fabricating an upper for an article of footwear, comprising:

providing a first sheet of material and a second sheet of material;

removing plural portions of the first sheet of material to form a set of first reinforcing strips, each first reinforcing strip separated from a directly adjacent first reinforcing strip by a space corresponding to a location of one of the plural portions removed from the first sheet of material;

removing plural portions of the second sheet of material to form a set of second reinforcing strips, each second reinforcing strip separated from a directly adjacent second reinforcing strip by a space corresponding to a location of one of the plural portions removed from the second sheet of material;

forming a reinforced panel by directly bonding the set of first reinforcing strips entirely to an exterior face of a carrier and directly bonding the set of second reinforcing strips entirely to an interior face of the carrier, wherein:

the first reinforcing strips are exposed to an exterior of the upper, each of the first reinforcing strips is approximately parallel to at least one adjacent first reinforcing strip and separated from that at least one adjacent first reinforcing strip by at least one unreinforced portion of the carrier exterior face, each of the second reinforcing strips is approximately parallel to at least one adjacent second reinforcing strip and separated from that at least one adjacent second reinforcing strip by at least one unreinforced portion of the carrier interior face, and each of the first reinforcing strips intersects at least one of the second reinforcing strips at respective intersections such that the first reinforcing strips and the second reinforcing strips are oriented to form acute angles at said respective intersections; and assembling the upper so that the reinforced panel forms a portion of the upper extending from at least a medial heel region, around a rear of the upper, and to at least a lateral heel region.

2. The method of claim 1, wherein assembling the upper comprises attaching the reinforced panel to one or more additional elements comprising at least a forefoot region of the upper.

3. The method of claim 2, wherein the carrier comprises a mesh material.

4. The method of claim 3, wherein the carrier is a single piece of the mesh material.

5. The method of claim 1, wherein each of the first reinforcing strips and each of the second reinforcing strips has a length along a dimension extending between top and bottom edges of the reinforced panel and an average width exceeded by the length.

6. The method of claim 1, wherein the set of first reinforcing strips comprises at least 10 first reinforcing strips and the set of second reinforcing strips comprises at least 10 second reinforcing strips.

7. The method of claim 1, wherein:

at least a portion of the first reinforcing strips on a lateral side have orientations angled acutely from the vertical and toward the front of the upper, at least a portion of the first reinforcing strips on a medial side have orientations angled acutely from the vertical and toward the front of the upper, and at least a portion of the second reinforcing strips on the lateral side have orientations angled acutely from the vertical and toward the rear of the upper.

8. The method of claim 7, wherein at least a portion of the second reinforcing strips on the medial side have orientations angled acutely from the vertical and toward the front of the upper.

9. The method of claim 1, wherein the composite panel forms a portion of the upper extending from at least the medial heel region, around the rear of the upper, and to at least a lateral midfoot region of the upper.

10. The method of claim 1, wherein the first reinforcing strips and the second reinforcing strips are formed from polyurethane coated thermoplastic polyurethane film.

11. The method of claim 1, wherein the step of forming the reinforced panel includes arranging the carrier between the first sheet of material forming the set of first reinforcing strips and the second sheet of material forming the set of second reinforcing strips and heat pressing to cause material of the first sheet of material forming the set of first reinforcing strips and material of the second sheet of material forming the set of second reinforcing strips to melt and flow into interstices of the carrier.

12. The method of claim 11, further comprising placing an eye stay reinforcement between the first sheet of material forming the set of first reinforcing strips and the second sheet of material forming the set of second reinforcing strips prior to the heat pressing.

13. The method of claim 11, wherein the step of arranging includes arranging the carrier between the first sheet of material forming the set of first reinforcing strips and the second sheet of material forming the set of second reinforcing strips in a flat configuration that is pressed during the heat pressing.

14. The method of claim 11, wherein at least one of the first sheet of material forming the set of first reinforcing strips and the second sheet of material forming the set of second reinforcing strips comprises a thermoplastic polyurethane film having a polyurethane coating on one face.

15. The method of claim 1, wherein the step of forming the reinforced panel includes arranging the carrier between the first sheet of material forming the set of first reinforcing strips and the second sheet of material forming the set of second reinforcing strips and heat pressing to cause a portion of the first sheet of material forming the set of first reinforcing strips and a portion of the second sheet of material forming the set of second reinforcing strips to fuse into the carrier.

16. The method of claim 15, wherein the step of arranging includes arranging the carrier between the first sheet of material forming the set of first reinforcing strips and the second sheet of material forming the set of second reinforcing strips in a flat configuration that is pressed during the heat pressing.

17. The method of claim 15, wherein at least one of the first sheet of material forming the set of first reinforcing strips and the second sheet of material forming the set of second reinforcing strips comprises a thermoplastic polyurethane film having a polyurethane coating on one face.

18. The method of claim 1, further comprising:

attaching a front lateral edge of the reinforced panel to a forefoot element of the upper.

19. The method of claim 16, further comprising:

attaching a front medial edge of the reinforced panel to a midfoot element of the upper.

20. The method of claim 1, further comprising:

attaching a front medial edge of the reinforced panel to a midfoot element of the upper.

* * * * *